US011311782B2

(12) United States Patent
Ozaki et al.

(10) Patent No.: US 11,311,782 B2
(45) Date of Patent: Apr. 26, 2022

(54) GOLF CLUB HEAD

(71) Applicant: Sumitomo Rubber Industries, Ltd., Hyogo (JP)

(72) Inventors: Yohei Ozaki, Kobe (JP); Masahide Onuki, Kobe (JP); Seiji Hayase, Kobe (JP)

(73) Assignee: Sumitomo Rubber Industries, Ltd., Hyogo (JP)

( * ) Notice: Subject to any disclaimer, the term of this patent is extended or adjusted under 35 U.S.C. 154(b) by 0 days.

(21) Appl. No.: 16/877,009

(22) Filed: May 18, 2020

(65) Prior Publication Data

US 2020/0391088 A1 Dec. 17, 2020

(30) Foreign Application Priority Data

Jun. 14, 2019 (JP) ..... JP2019-111079

(51) Int. Cl.
*A63B 53/04* (2015.01)
*A63B 60/48* (2015.01)
*A63B 60/00* (2015.01)

(52) U.S. Cl.
CPC ..... *A63B 53/0466* (2013.01); *A63B 60/48* (2015.10); *A63B 53/0408* (2020.08); *A63B 53/0437* (2020.08); *A63B 60/00* (2015.10)

(58) Field of Classification Search
CPC ..... A63B 53/0466; A63B 53/0408; A63B 53/0437; A63B 60/00; A63B 60/48; A63B 60/54
USPC ..... 473/332
See application file for complete search history.

(56) References Cited

U.S. PATENT DOCUMENTS 7,108,614 B2 * 9/2006 Lo ..... A63B 53/0466 473/345
2003/0119603 A1 6/2003 Yabu
2008/0045356 A1 * 2/2008 Lin ..... A63B 53/0466 473/346
2010/0255931 A1 * 10/2010 Ni ..... A63B 53/0466 473/346
2011/0306441 A1 * 12/2011 Tsukada ..... A63B 60/52 473/345
2014/0329616 A1 * 11/2014 Stokke ..... A63B 53/0466 473/346
2015/0273289 A1 * 10/2015 Ashino ..... A63B 60/00 473/332
2015/0290503 A1 * 10/2015 Su ..... A63B 53/0466 473/324
2015/0298196 A1 * 10/2015 Su ..... B21K 17/00 72/342.8

(Continued)

FOREIGN PATENT DOCUMENTS

JP 2003-180885 A 7/2003

*Primary Examiner* — John E Simms, Jr.
(74) *Attorney, Agent, or Firm* — Studebaker & Brackett PC

(57) ABSTRACT

A golf club head having a cavity therein comprises a wall at least a part of which is formed as a convexo-concave wall portion. The convexo-concave wall portion is composed of convexed portions repeatedly arranged in a first direction and a second direction intersecting the first direction, and concaved portions formed between the convexed portions. Each of the convexed portions includes at least one first protrusion extending in the first direction and at least one second protrusion extending in the second direction.

17 Claims, 16 Drawing Sheets

(56) References Cited

U.S. PATENT DOCUMENTS

2016/0250534 A1* 9/2016 Solheim ..... A63B 53/0466
473/346

* cited by examiner

GOLF CLUB HEAD

TECHNICAL FIELD

The present invention relates to a golf club head, more particularly to a wall structure of a hollow golf club head.

BACKGROUND ART

Japanese Patent Application Publication No. 2003-180885 discloses a hollow golf club head having a cavity therein. This type of golf club head comprises a wall (including, for example, a face portion, a crown wall, a sole wall, etc.) surrounding the cavity.

SUMMARY OF THE INVENTION

Problems to be Solved by the Invention

Reducing the thickness of such wall constituting a hollow golf club head is useful for reducing the mass of the golf club head and as well as designing the mass distribution of the golf club head. For example, by reducing the thickness of the crown wall, it is possible to lower the position of the center of gravity of the head.

On the other hand, such reducing of the wall thickness may reduce the rigidity of the golf club head.

The present invention was therefore, made in view of the above problems, and a primary objective of the present invention is to provide a golf club head in which it is possible to reduce the wall thickness without impairing the rigidity of the head.

According to the present invention, a golf club head has a cavity therein and comprises:

a wall at least a part of which is formed as a patterned convexo-concave wall portion, wherein the convexo-concave wall portion is composed of convexed portions repeatedly arranged in a first direction and a second direction intersecting the first direction, and concaved portions formed between the convexed portions, and each of the convexed portions is composed of at least one first protrusion extending in the first direction, and at least one second protrusion extending in the second direction.

The convexo-concave wall portion may constitute a curved portion of the wall which is curved along a curved plane.

The wall provided with the convexo-concave wall portion may be a crown wall of the golf club head forming an upper surface of the golf club head.

As to the overall area of the golf club head measured in the top view of the golf club head under its standard state, the convexo-concave wall portion may occupy an area of from 10% to 95% of the overall area.

The above-said at least one first protrusion may be four first protrusions, and the above-said at least one second protrusion may be four second protrusions.

The above-said at least one first protrusion may be two first protrusions, and the above-said at least one second protrusion may be two second protrusions.

The above-said at least one first protrusion may be one first protrusion, and the above-said at least one second protrusion may be two second protrusions connected to both ends of the one first protrusion.

The concaved portions and the convexed portions may have the same contour shape.

The convexo-concave wall portion may be made of a metal material, and the thickness of the metal material in the convexo-concave wall portion may be in a range from 0.25 to 0.50 mm.

The difference in height between the convexed portions and the concaved portions may be in a range from 0.6 to 4.0 mm.

Each convexed portion may be formed in such a size that a smallest square which circumscribes the convexed portion in the plan view of the convexed portion, has four sides whose length is 10 to 40 mm.

The first direction may be substantially parallel with a front-back direction of the golf club head, and the second direction may be substantially parallel with a toe-heel direction of the golf club head.

In the golf club head according to the present invention, as the wall is provided with the convexo-concave wall portion having the specific configuration, the thickness of the wall can be reduced in the convexo-concave wall portion without impairing its rigidity. Therefore, the golf club head according to the present invention can achieve, for example, mass reduction of the club head and the increased flexibility of designing of the mass distribution.

DESCRIPTION OF THE PREFERRED EMBODIMENTS

Figure 1:
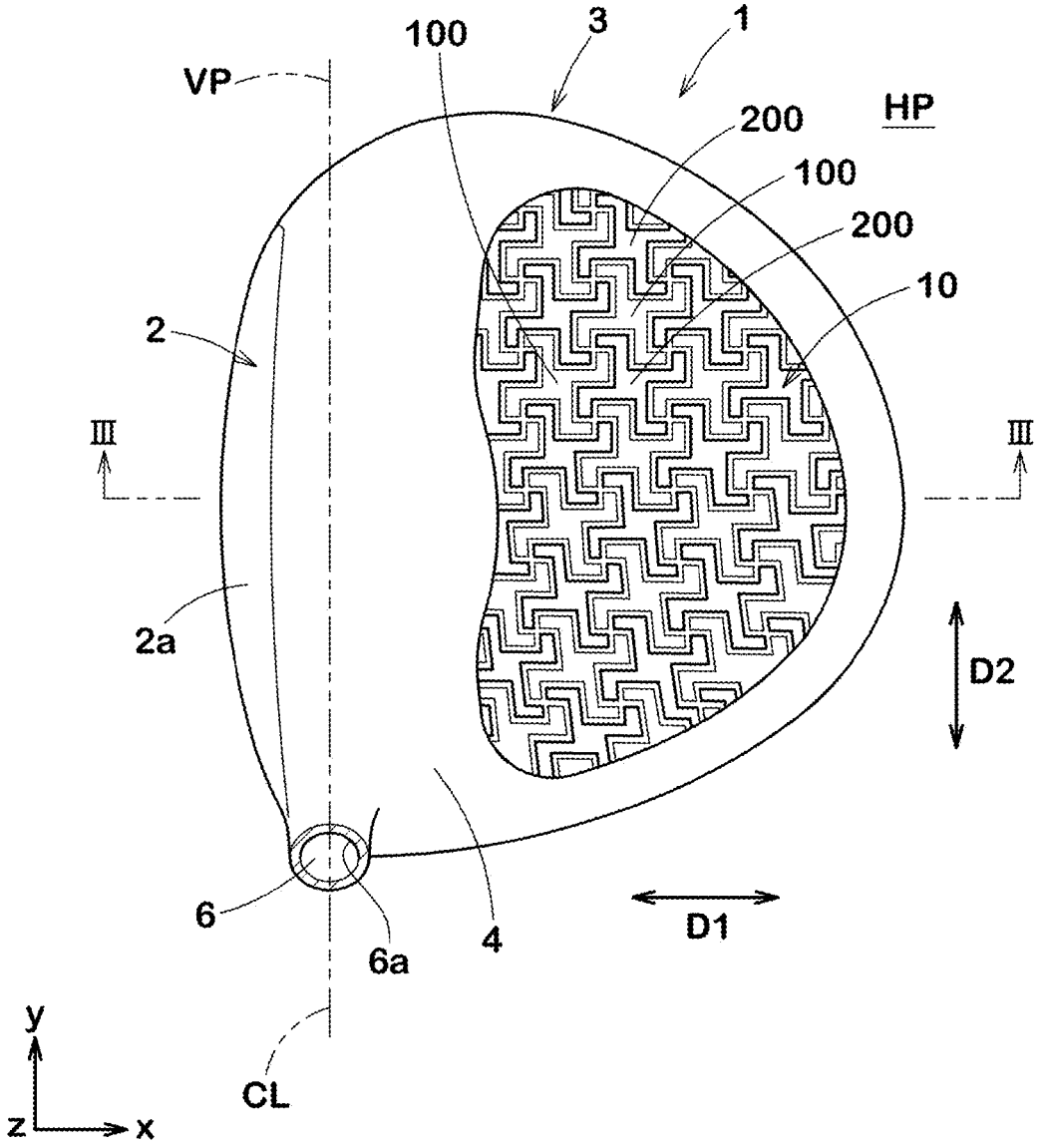
FIG. 1 is a top view of a golf club head as an embodiment of the present invention.

Embodiments of the present invention will now be described in detail in conjunction with accompanying drawings. In the following descriptions of the respective embodiments, the same or common elements are denoted by the same reference numerals, and redundant descriptions are omitted.

Figure 2:
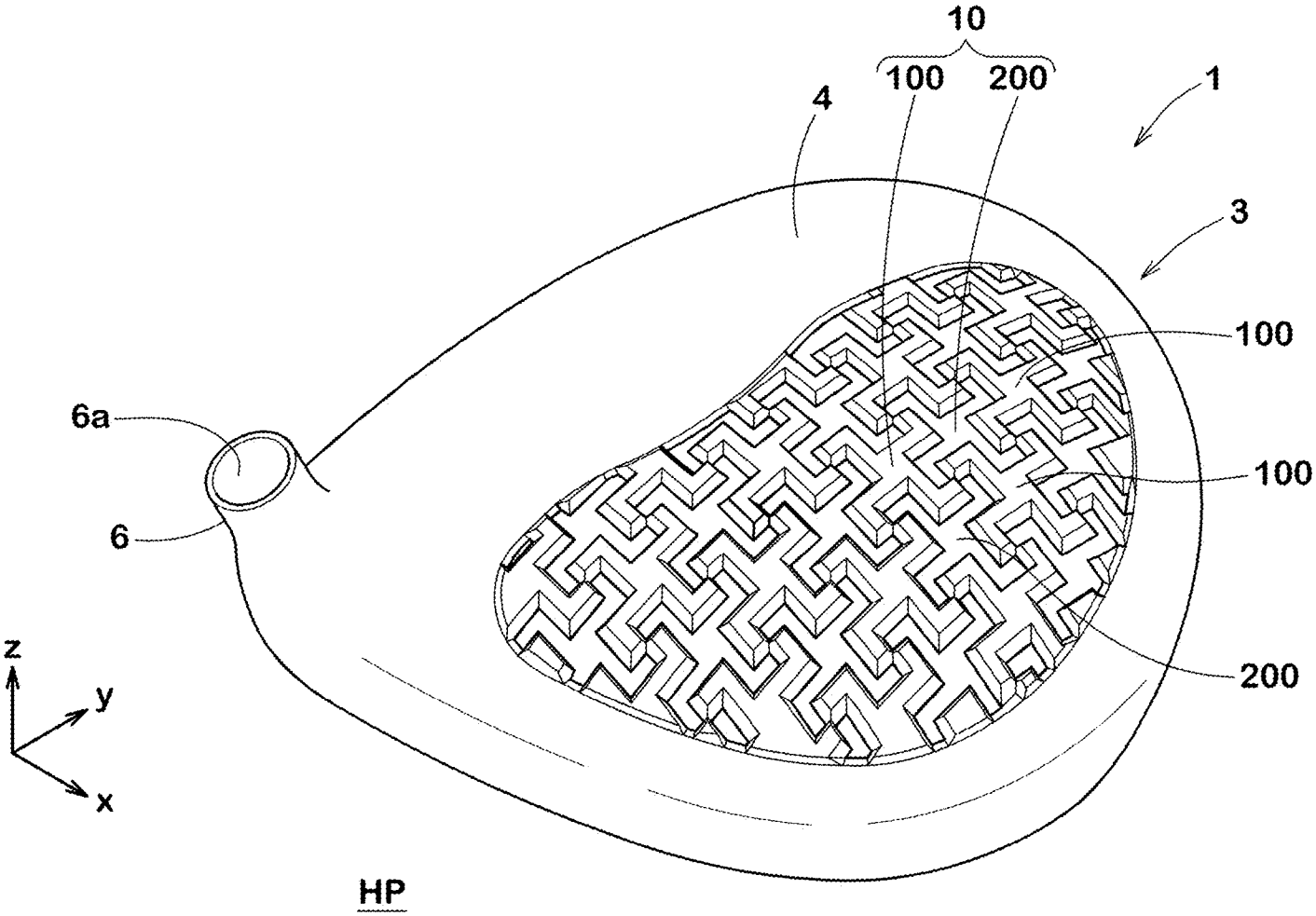
FIG. 2 is a perspective view thereof.

FIGS. 1 and 2 are a top view and a perspective view showing a golf club head 1 as an embodiment of present invention under a standard state of the head 1.

Figure 3:
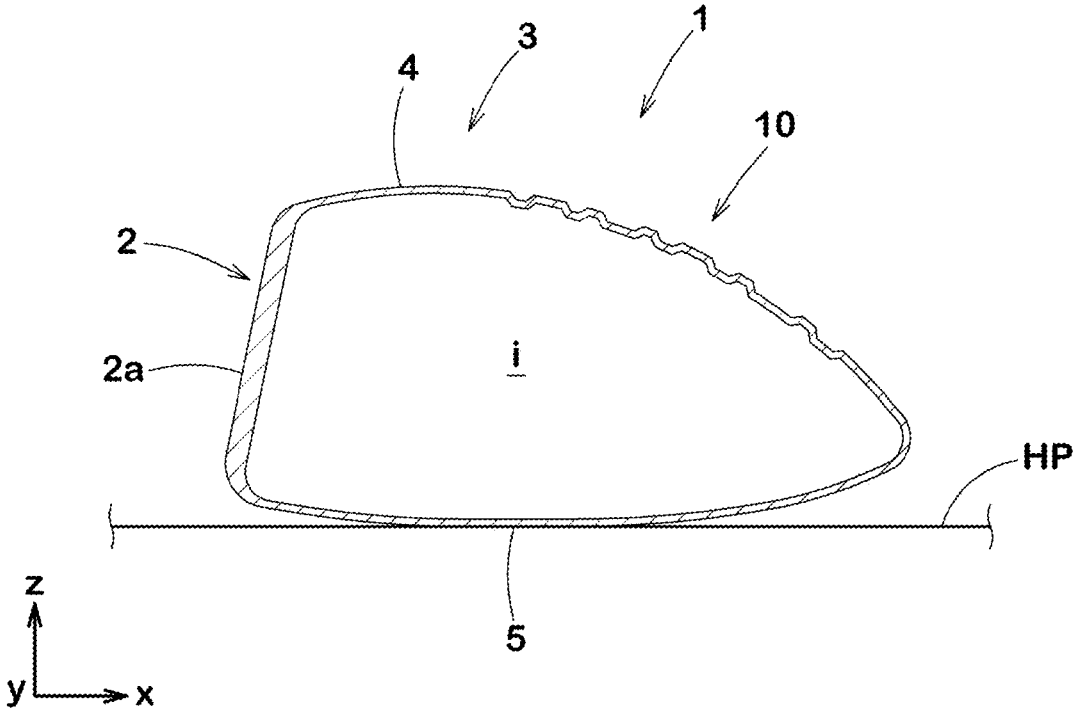
FIG. 3 is a sectional view taken along line III-III of FIG. 1.

FIG. 3 is a sectional view taken along line III-III of FIG. 1.

[Standard State of Head]

In this application including the description and claims, dimensions, positions, directions and the like relating to the club head refer to those under a standard state of the club head unless otherwise noted.

Here, the standard state of the club head is such that the club head is set on a horizontal plane HP so that the axis CL of the club shaft (not shown) is inclined at the specified lie angle while keeping the axis CL on a vertical plane VP as shown in FIG. 1, and the club face forms the specified loft angle with respect to the horizontal plane HP. Incidentally, in the case of the club head alone, the center line of the shaft inserting hole can be used instead of the axis CL of the club shaft.

[Directions about Head]

Three orthogonal directions relating to the head 1 are defined as follows:

a toe-heel direction y of the head which is parallel with the horizontal plane HP and the vertical plane VP, a front-back direction x of the head which is parallel with the horizontal plane HP and perpendicular to the vertical plane VP, and an up-down direction z of the head which is orthogonal to both the directions x and y.

[Basic Structure of Head]

In the present embodiment shown in FIGS. 1 to 3, the head 1 has an internal cavity i as shown in FIG. 3, and formed as a wood-type head having a wood shape for example.

Wood-type heads include a driver (#1) and a fairway wood. The head 1 may be preferably formed as a driver.

Aside from the wood-type, the head 1 may be formed as a utility type head or an iron type head as long as it has a cavity i.

In the present embodiment, a major part of the head 1 is made of a metal material. As to the metal material, various materials, for example, titanium, titanium alloy, stainless steel, aluminum alloy and the like can be used.

Further, it may be possible that the head 1 is partially made of a nonmetallic material such as resin, rubber, elastomer, fiber reinforced resin or the like.

The head 1 is composed of a face portion 2, and a main body portion 3 extending rearward of the head from the face portion 2.

The face portion 2 in this example is formed in the form of a plate. The front surface of the face portion 2 forms a ball hitting surface 2*a*. The back surface (not shown) of the face portion 2 faces the internal cavity i.

As shown in FIGS. 1 to 3, the main body portion 3 of the head 1 is formed by a wall including a crown wall 4 and a sole wall 5.

The crown wall 4 is continuous with the face portion 2 and forms the upper surface of the head.

Preferably, the crown wall 4 is smoothly convexly curved as shown in FIG. 3, for example, along a substantially spherical surface. However, it may be possible that the crown wall 4 is smoothly concavely curved.

The sole wall 5 is continuous with the face portion 2 and forms the bottom surface of the head.

In the present embodiment, the sole wall 5 is connected to the crown wall 4 via a smooth curved surface.

However, it may be possible that the main body portion 3 further includes a side wall extending in the up-down direction of the head 1 to connect between the sole wall 5 and the crown wall 4. Thus, the above-said wall further includes the side wall.

Further, the head 1 comprises a hosel portion 6 having the above-said shaft inserting hole 6*a* into which a golf club shaft (not shown) is fixed.

The center line of the shaft inserting hole 6*a* corresponds to the axis CL of the inserted club shaft.

The hosel portion 6 in this example has a cylindrical shape and is formed in a heel-side portion of the crown wall 4.

[Convexo-Concave Wall Portion]

According to the present invention, a convexo-concave wall portion 10 forms at least a part of the above-said wall constituting the head 1.

Here, the wall constituting the head 1 includes the face portion 2, the crown wall 4 and the sole wall 5 in this example, and optionally the above-said side wall.

Preferably, the convexo-concave wall portion 10 is provided in the wall constituting the main body portion 3 of the head 1. In the present embodiment, the convexo-concave wall portion 10 is provided in the crown wall 4.

However, the convexo-concave wall portion 10 may be provided in the sole wall 5 or in the face portion 2.

Further, the convexo-concave wall portion 10 may be provided in two or more of the face portion 2, the crown wall 4 and the sole wall 5, and optional side wall.

Figure 4:
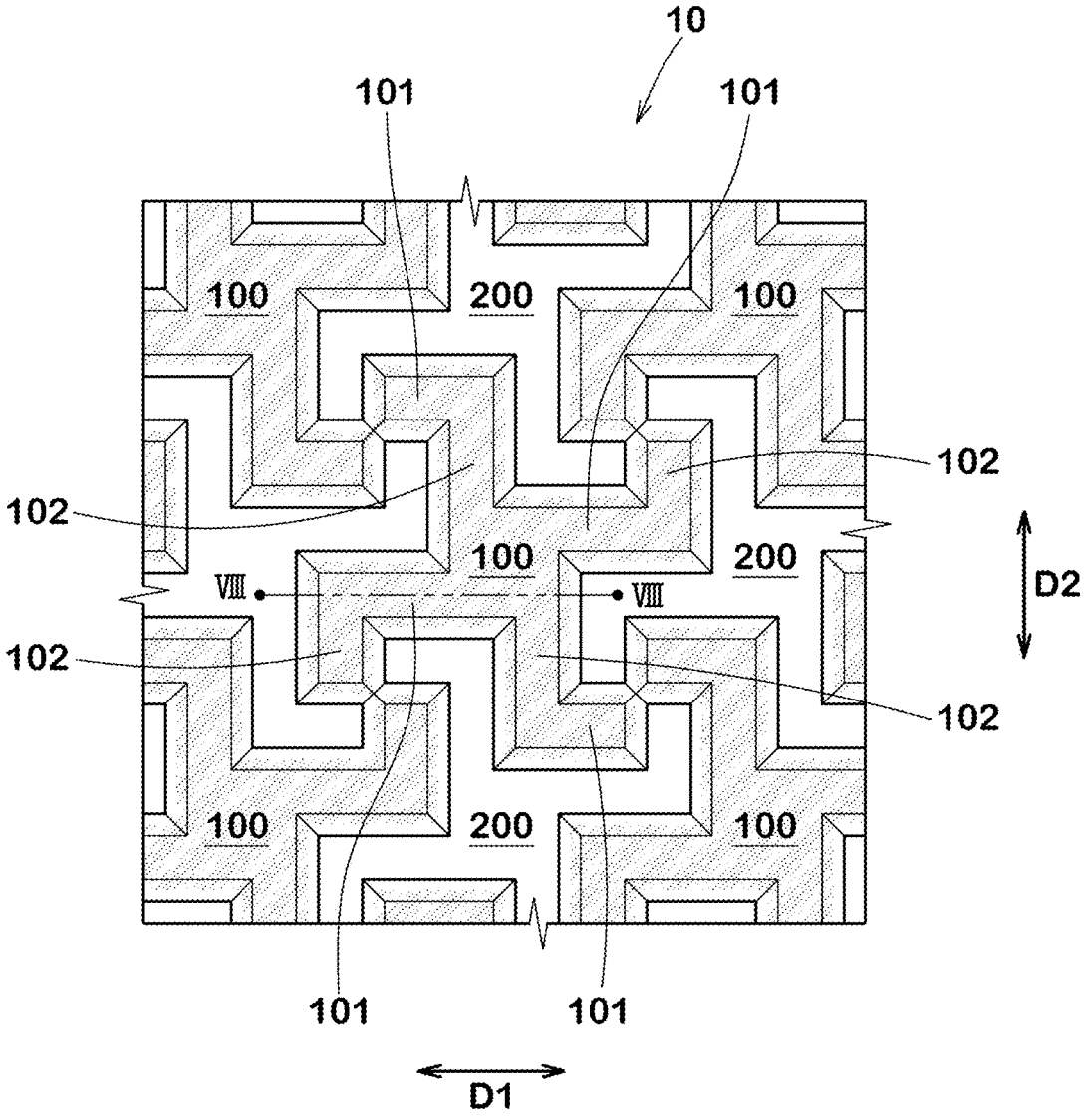
FIG. 4 is a plan view of a part of the convexo-concave wall portion of FIG. 1.
Figure 5:
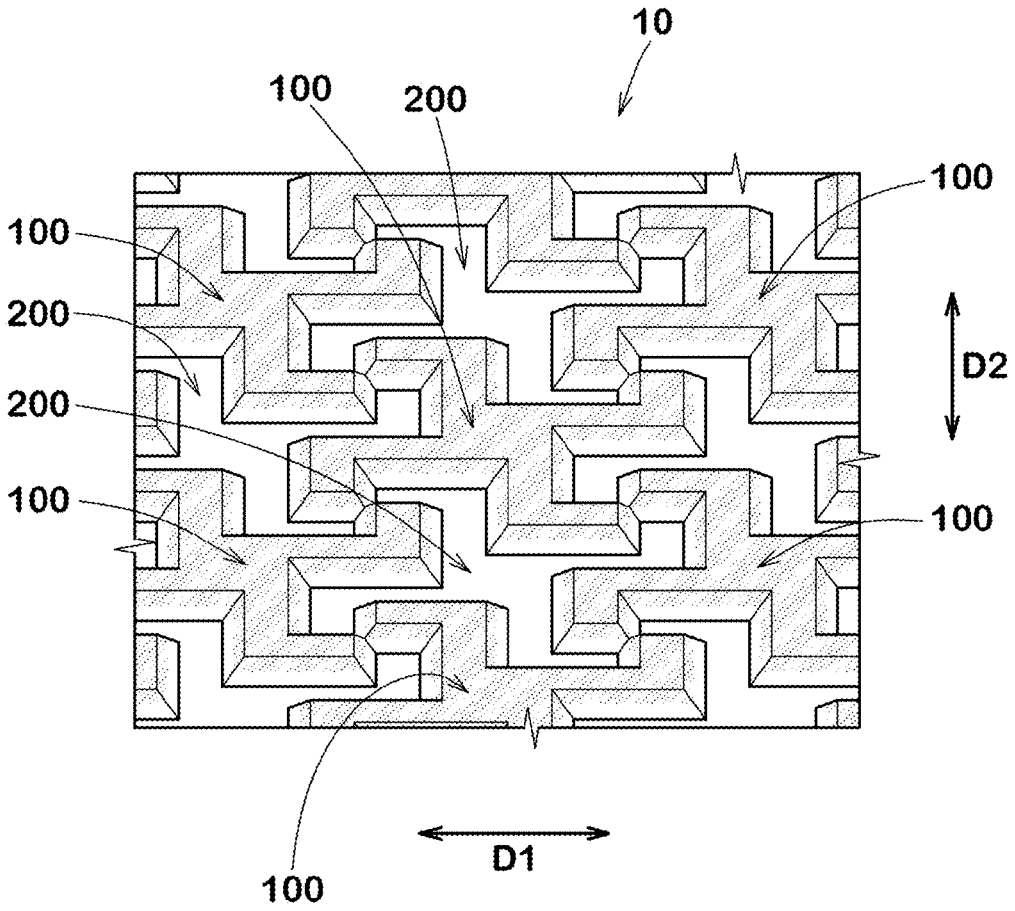
FIG. 5 is a perspective view of a part of the convexo-concave wall portion of FIG. 1.

FIG. 4 shows a part of the convexo-concave wall portion 10. FIG. 5 is a perspective view of a part of the convexo-concave wall portion 10.

As shown, in the convexo-concave wall portion 10, multiple convexed portions 100 are repeatedly arranged in a first direction D1 and a second direction D2 intersecting the first direction D1. And, concaved portions 200 are formed between the convexed portions 100.

Thus, the convexo-concave wall portion 10 has a patterned outer surface, and as can be seen from FIG. 3, the inner surface thereof is also a patterned surface having the inverse or complementary pattern.

Figure 6:
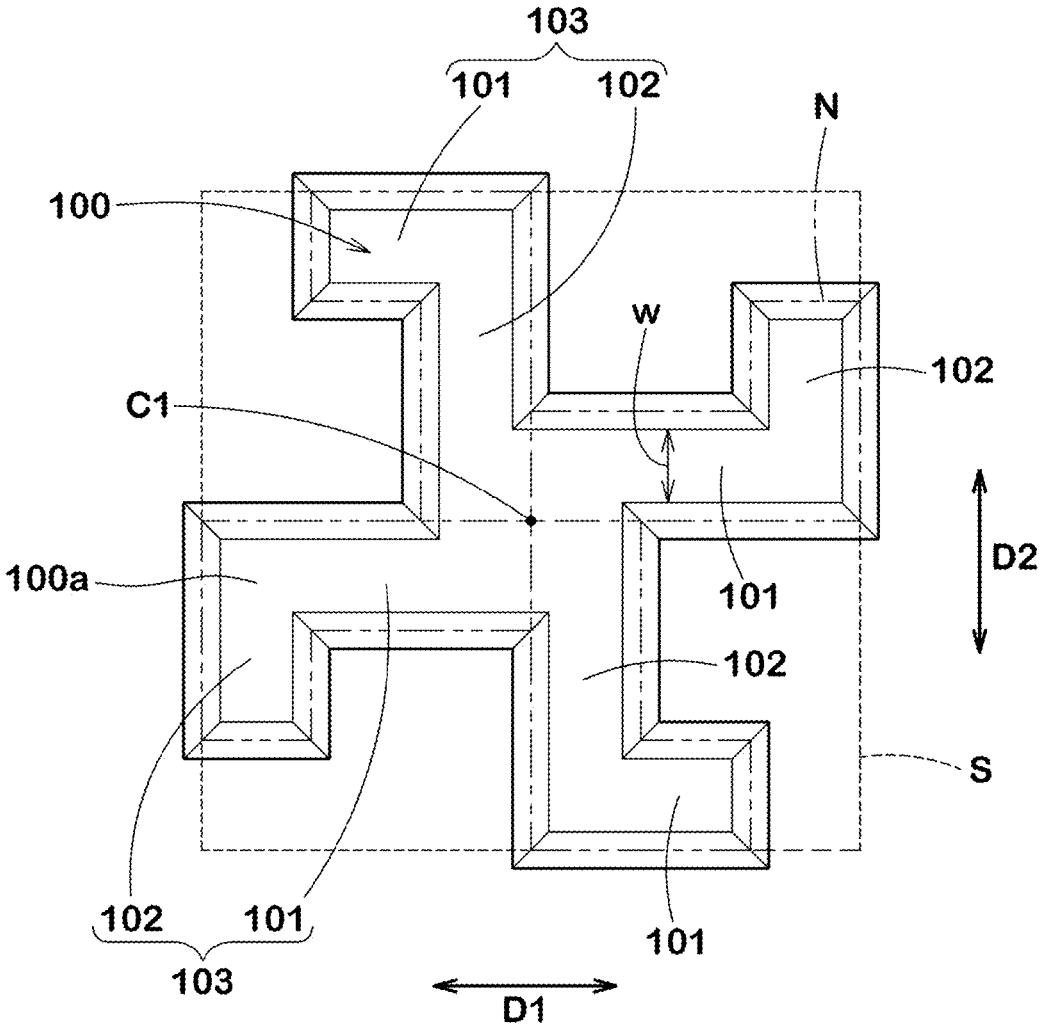
FIG. 6 is a plan view showing one of the convexed portions.

Each of the convexed portions 100 is composed of at least one rib-like first protrusion 101 extending in the first direction D1, and at least one rib-like second protrusion 102 extending in the second direction D2 as shown in FIG. 6 which shows one of the convexed portions 100.

As described above, in the convexo-concave wall portion 10 of the present embodiment, the convexed portions 100 are repeatedly arranged in the first direction D1 and the intersecting second direction D2, and the concaved portions 200 are formed between the convexed portions 100. Further, each of the convexed portions 100 comprises at least one rib-like first protrusion 101 extending in the first direction D1 and at least one rib-like second protrusion 102 extending in the second direction D2. As a result, the convexo-concave wall portion 10 is increased in the bending rigidity in the first direction D1 and the second direction D2.

Therefore, in the head 1 according to the present invention, the wall can be reduced in the thickness in the convexo-concave wall portion without reducing the bending rigidity. This facilitates the mass reduction of the head 1 and the designing of the mass distribution, for example.

The mass reduction of the wall can produce a mass margin for increasing the design freedom of the mass distribution of the head 1.

In the case of the convexo-concave wall portion 10 formed as a part of the crown wall 4 as in the present embodiment, by making the convexo-concave wall portion 10 thinner, the mass of the crown wall 4 (namely, the mass of an upper part of the club head) is reduced. This makes it possible to lower the center of gravity of the head 1.

As shown in FIG. 1, the area of the convexo-concave wall portion 10 measured in the top view of the head 1 under the above-said standard state, is set to be not less than 10%, preferably not less than 30%, but not more than 95%, preferably not more than 80% of the overall area of the head 1, namely, the area surrounded by the head's outline measured in the above-said top view.

Preferably, the first direction D1 is substantially parallel with the front-back direction x of the head, and the second direction D2 is substantially parallel with the toe-heel direction y of the head.

In general, when a golf ball is hit, a large force in the first direction D1 acts on the hitting surface 2*a* of the face portion 2, and this force is transmitted to the crown wall 4. Therefore, the crown wall 4 undergoes such bending deformation that the crown wall 4 is bent convexly toward the upper side of the head.

However, the convexo-concave wall portion 10 suppresses such bending deformation of the crown wall 4, and thus helps to significantly increase the durability of the crown wall 4 against ball hitting.

In this application including the description and claims, the expression "substantially parallel" means that the angle between the two objects is at most 15 degrees.

Preferably, the convexed portions 100 are each composed of multiple lib-like first protrusions 101 extending in the first direction D1, and multiple lib-like second protrusions 102 extending in the second direction D2.

FIG. 6 shows one of the convexed portions 100 in the present embodiment. As shown, the convexed portion 100 is composed of four first protrusions 101 extending straight in substantially parallel with the first direction D1, and four second protrusions 102 extending straight in substantially parallel with the second direction D2.

The four first protrusions 101 extend in parallel with each other, and are displaced from each other in the second direction D2.

The four second protrusions 102 extend in parallel with each other, and are displaced from each other in the first direction D1.

In the convexed portion 100 of the present embodiment shown in FIG. 6, one of the first protrusions 101 is connected to one of the second protrusions 102.

Preferably, one first protrusion 101 and one second protrusion 102 are connected to each other so as to form a corner, thereby forming an L-shaped convex unit 103.

Each convexed portion 100 is made up of four L-shaped convex units 103 which are rotated and arranged around the center C1 of the convexed portion at an angular pitch of 90 degrees. The convexed portion 100 has a swastika-like contour shape.

In FIG. 6, "N" denotes the boundary line between the convexed portion 100 and the surrounding four concaved portions 200.

Each concaved portion 200 is composed of at least one first concaved portion 201 extending in the first direction D1, and at least one second concaved portion 202 extending in the second direction D2.

Figure 7:
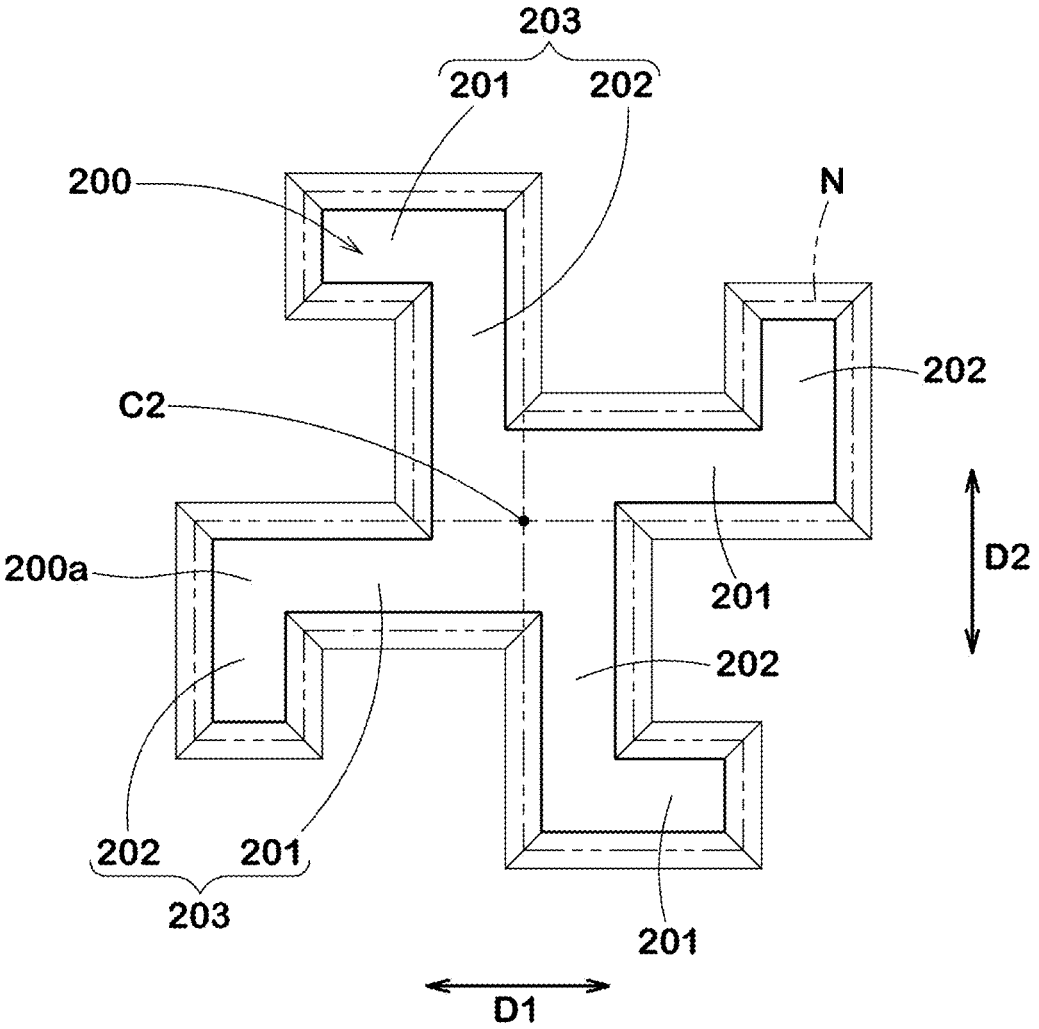
FIG. 7 is a plan view showing one of the concaved portions.

FIG. 7 shows one of the concaved portions 200 in the present embodiment. As shown, the concaved portion 200 is composed of four first concaved portions 201 extending straight in substantially parallel with the first direction D1, and four second concaved portions 202 extending straight in substantially parallel with the second direction D2.

The four first concaved portions 201 extend in parallel with each other, and are displaced from each other in the second direction D2.

The four second concaved portions 202 extend parallel with each other, and are displaced from each other in the first direction D1.

In the concaved portion 200 of the present embodiment shown in FIG. 7, one of the first concaved portions 201 is connected to one of the second concaved portions 202. Preferably, one first concaved portion 201 and one second concaved portion 202 are connected to each other so as to form a corner, thereby forming an L-shaped concave unit 203.

Each concaved portion 200 is made up of four L-shaped concave units 203 which are rotated and arranged around the center C2 of the concaved portion at an angular pitch of 90 degrees. The concaved portion 200 has a swastika-like contour shape.

As is clear from the comparison between FIG. 6 and FIG. 7, the convexed portions 100 and the concaved portions 200 have the same contour shape, and the first concaved portions 201 and the second concaved portions 202 correspond to the first protrusions 101 and the second protrusions 102, respectively.

Here, the contour shape of one convexed portion 100 is that of a most protruding part 100*a* of the surface of the convexo-concave wall portion 10, and the contour shape of one concaved portion 200 is that of a most denting part 200*a* of the surface of the convexo-concave wall portion 10.

By configuring the convexed portions 100 and the concaved portions 200 to have the same contour shape in this way, it becomes possible to eliminate anisotropy at the time of deformation of the convexo-concave wall portion 10. Thereby, the strength of the convexo-concave wall portion 10 can be improved in a well-balanced manner.

Figure 8:
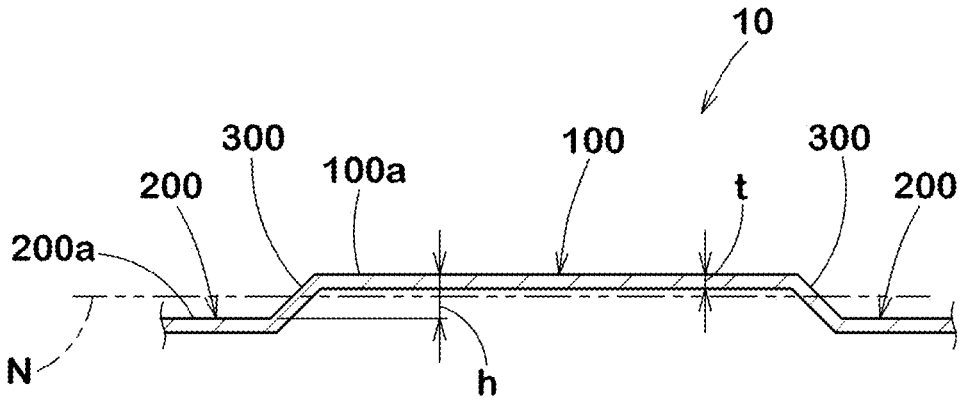
FIG. 8 is a sectional view taken along line VIII-VIII of FIG. 4.

As shown in FIG. 8 which is a sectional view taken along line VIII-VIII of FIG. 4, the convexed portions 100 (most protruding surface parts 100*a*) are connected to the concaved portions 200 (most denting surface part 200*a*) through a side-wall surface part 300.

In this example, the side-wall surface part 300 is an inclined surface, but the side-wall surface part 300 may extend perpendicular to the surface parts 100*a* and 200*a*.

In the present embodiment, the convexo-concave wall portion 10 is made of a metal material. As the metal material, various materials, e.g. titanium, titanium alloy, stainless steel, aluminum alloy and the like can be used. In particular, a titanium alloy having a large specific strength is preferable. However, the convexo-concave wall portion 10 may be made of a non-metallic material such as a resin and a fiber reinforced resin.

The convexo-concave wall portion 10 of the present embodiment can be made thinner without losing its rigidity by having the above structure.

The thickness t of the convexo-concave wall portion 10 (metal material thickness t) is preferably set to be at most 1.00 mm, more preferably at most 0.7 mm, still more preferably at most 0.6 mm, yet still more preferably at most 0.5 mm in view of the mass reduction and mass distribution design.

However, from the viewpoint of maintaining the durability of the head 1, the thickness t is preferably at least 0.25 mm, more preferably at least 0.3 mm, still more preferably at least 0.35 mm, yet still more preferably at least 0.4 mm.

Preferably, the difference h between the heights of the unevenness of the convexo-concave wall portion 10, that is, the height from the most denting surface part 200*a* to the most protruding surface part 100*a* (shown in FIG. 8), is set in a range from 0.6 to 4.0 mm, particularly preferably 2.0 to 3.0 mm. If the height difference h is small, there is a tendency that the effect of improving the bending rigidity of the convexo-concave wall portion 10 becomes insufficient.

If the height h is too large, there is a possibility that the convexo-concave wall portion 10 is decreased in the compressive and tensile rigidity in its own plane.

The sizes of the convexed portions 100 in the convexo-concave wall portion 10 are not particularly limited. But, in order to obtain a sufficient effect of increasing the bending rigidity without impairing the productivity and the workability, it is preferred that, in the top view of the convexo-concave wall portion 10, each convexed portion 100 has such a size that a smallest square s which circumscribes the convexed portion 100 (most protruding surface part 100*a*) as shown in FIG. 6, has four sides whose length is in a range from 10 to 40 mm.

When the convexo-concave wall portion 10 is formed along a curved plane as in the present embodiment (FIG. 3), it is developed along a flat plane, and then the smallest square s is determined.

The convexo-concave wall portion 10 can be manufactured by various methods. For example, by pressing a thin metal sheet constituting the wall, the convexo-concave wall portion 10 can be formed on the metal sheet. By using such thin metal plate for a part of the wall or the entire wall, the head 1 in the present embodiment can be manufactured.

Figure 9:
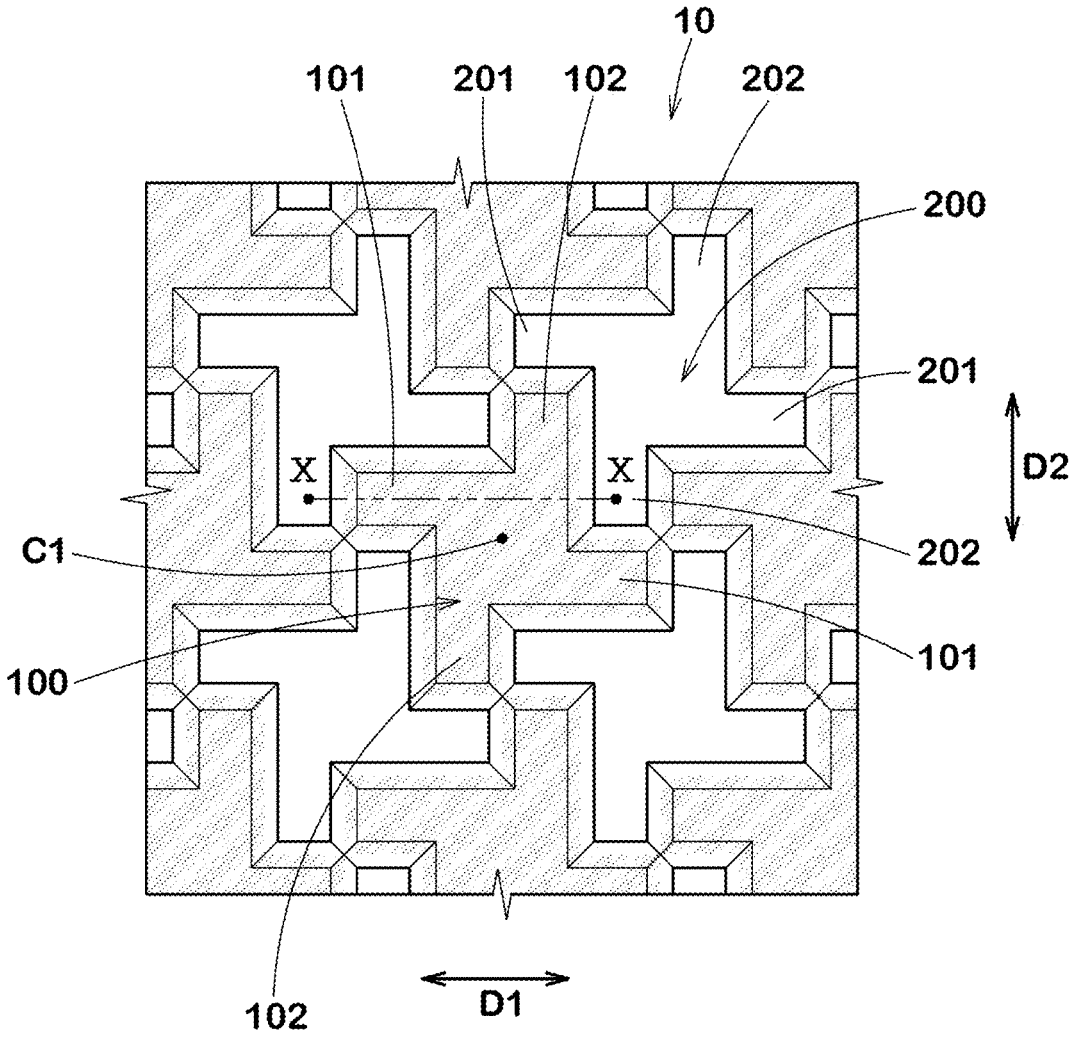
FIG. 9 is a plan view showing another example 1 of the convexo-concave wall portion.
Figure 10:
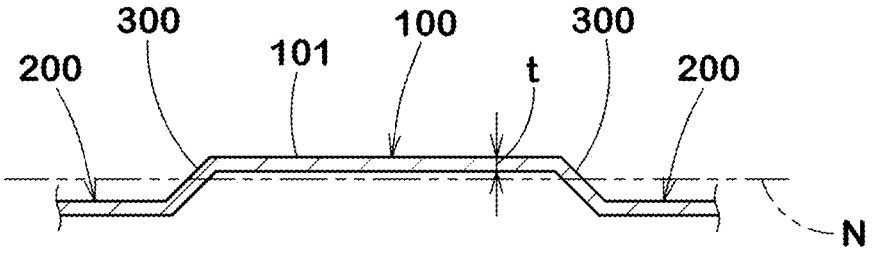
FIG. 10 is a sectional view taken along line x-x of FIG. 9.

FIG. 9 shows a second example of the convexo-concave wall portion 10 which is a modification 1 of the above-described convexo-concave wall portion 10. FIG. 10 is a sectional view taken along line x-x of FIG. 9.

In the second example, each of the convexed portions 100 is composed of two rib-like first protrusions 101 extending straight in substantially parallel with the first direction D1, and two rib-like second protrusions 102 extending straight in substantially parallel with the second direction D2.

The first protrusions 101 extend parallel to each other, and are displaced from each other in the second direction D2.

The second protrusions 102 extend in parallel with each other, and are displaced from each other in the first direction D1. In this example too, the convexed portions 100 and the concaved portions 200 have the same contour shape.

Such convexo-concave wall portion 10 can also make the wall of the head 1 thinner without impairing the rigidity.

Figure 11:
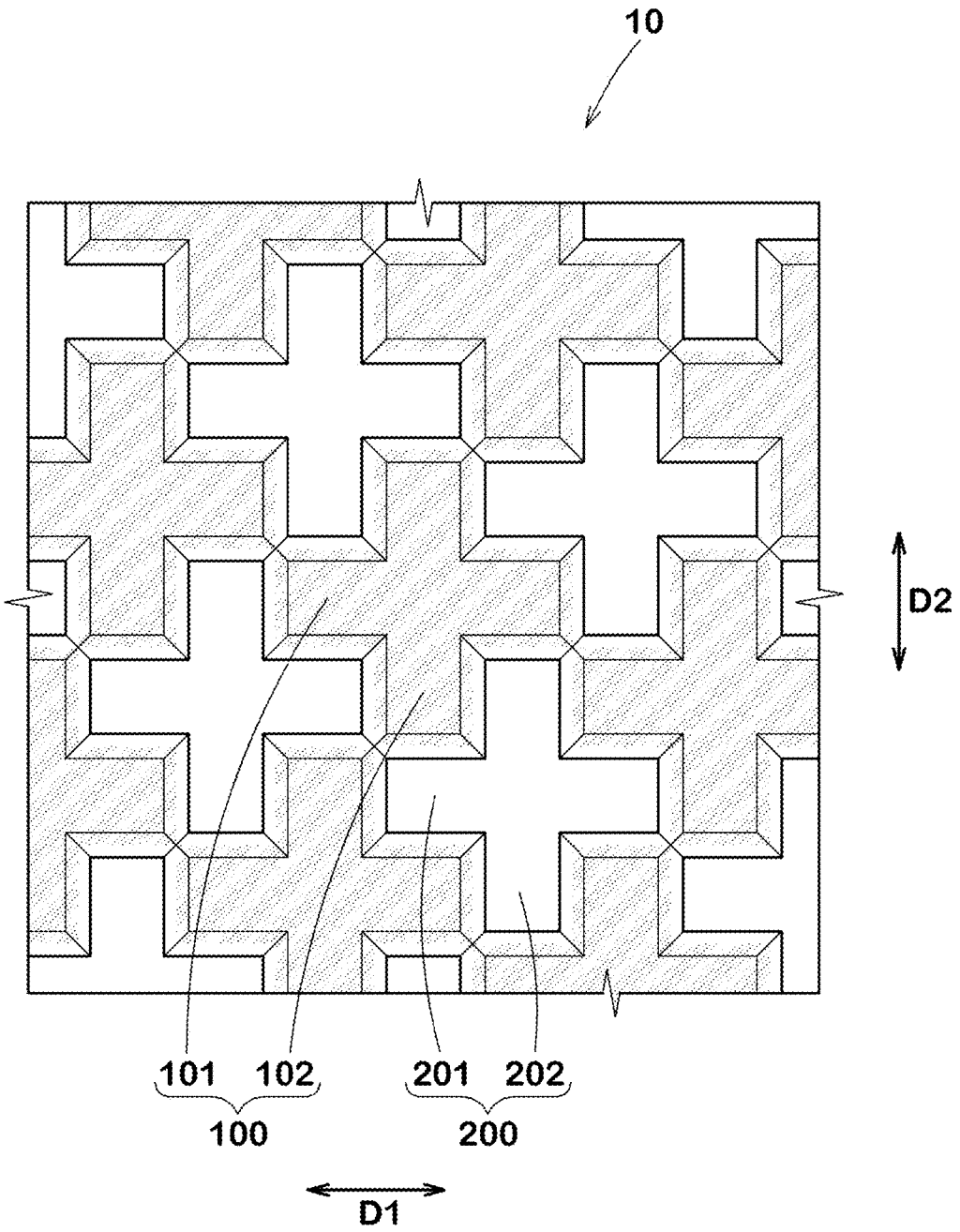
FIG. 11 is a plan view showing still another example 2 of the convexo-concave wall portion.

FIG. 11 shows a third example of the convexo-concave wall portion 10. In the third example, each of the convexed portions 100 is composed of one rib-like first protrusion 101 and one rib-like second protrusion 102 which intersect one another so as to form a cross.

In this example too, the convexed portions 100 and the concaved portions 200 have the same contour shape.

Such convexo-concave wall portion 10 can also make the wall of the head 1 thinner without impairing the rigidity.

Figure 12:
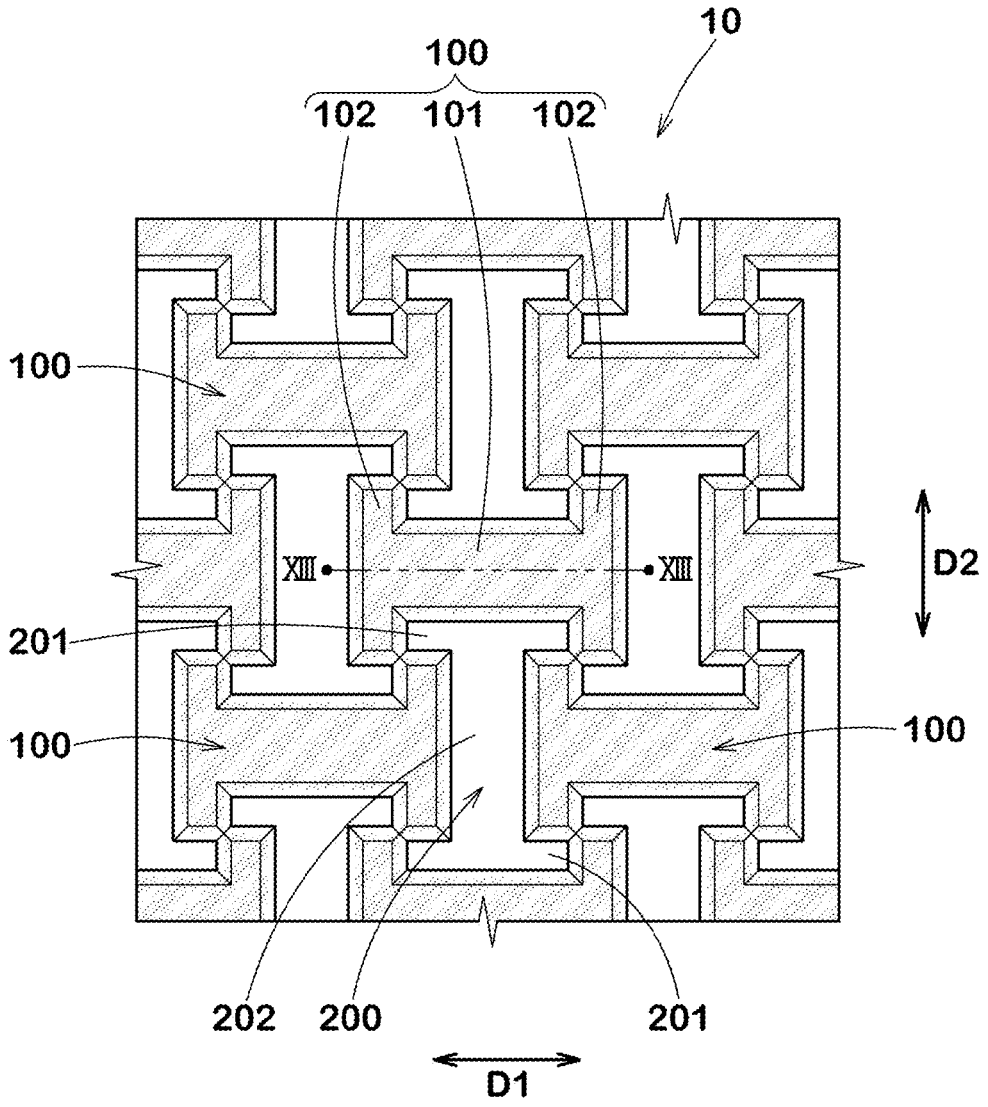
FIG. 12 is a plan view showing yet still another example 3 of the convexo-concave wall portion.
Figure 13:
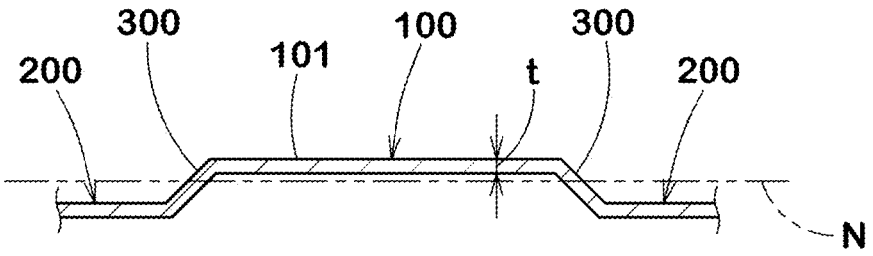
FIG. 13 is a sectional view taken along line XIII-XIII in FIG. 12.

FIG. 12 shows a fourth example of the convexo-concave wall portion 10. FIG. 13 is a sectional view taken along line XIII-XIII of FIG. 12.

In the fourth example, each of the convexed portions 100 is composed of one rib-like first protrusion 101 and two rib-like second protrusions 102, and the two second protrusions 102 are respectively connected to both ends of the first protrusion 101 in the form of a capital I. In the fourth example, each of the concaved portions 200 comprises one second concaved portions 202 and two first concaved portions 201, and the two first concaved portions 201 are respectively connected to both ends of the second concaved portions 202 in the form of a capital I.

In this example too, the convexed portions 100 and the concaved portions 200 have the same contour shape.

Such convexo-concave wall portion 10 can also make the wall of the head 1 thinner without impairing the rigidity.

While detailed description has been made of preferable embodiments of the present invention, the present invention can be embodied in various forms without being limited to the illustrated embodiments. Thus, it must be understood that the present invention includes all modifications, equivalents and alternatives falling within the spirit and scope of the invention as set forth in the appended claims.

[Performance Evaluation 1]

Firstly, convexo-concave wall portions having specifications listed in Table 1 (test examples 1 to 3) were computer-simulated to obtain their bending rigidity.

Figure 14:
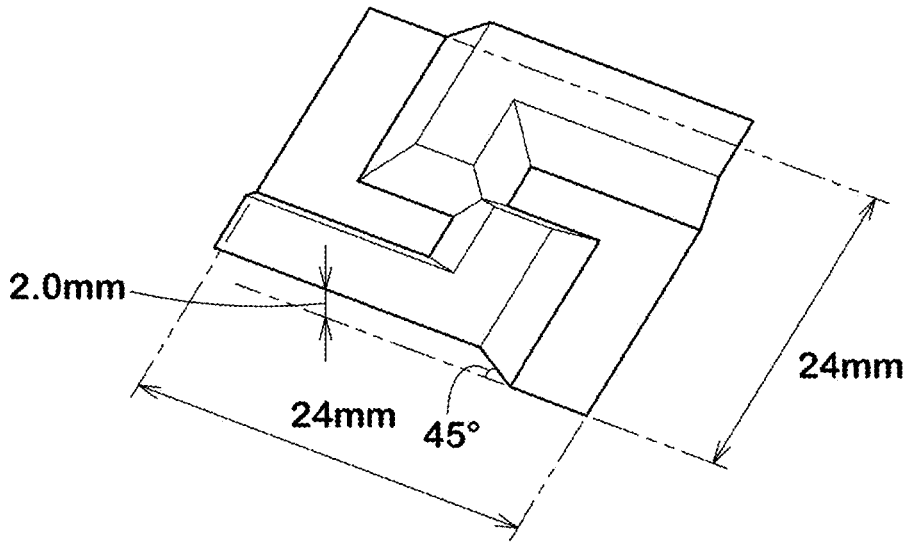
FIG. 14 is a perspective view showing a basic unit constituting the convexo-concave wall portion.
Figure 15:
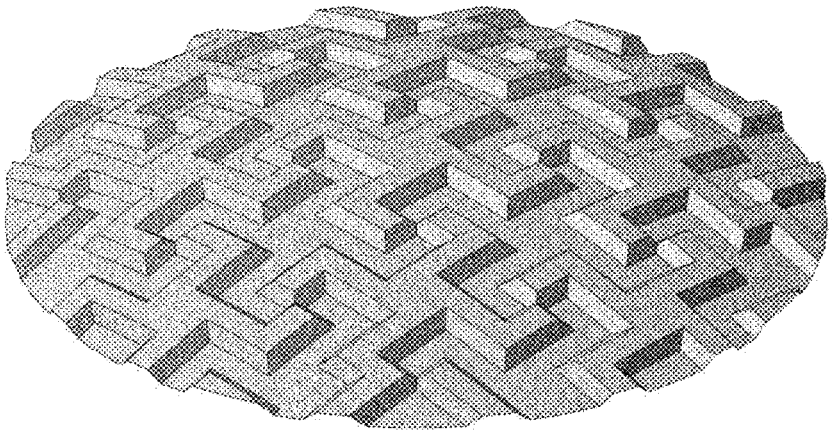
FIG. 15 is a perspective view showing the convexo-concave wall portion of a test example 4.

The test examples 1 to 3 were each based on a 120×120 mm square flat plate made of a titanium base alloy and respectively provided with the convexo-concave patterns shown in FIGS. 4, 9 and 12, wherein each of the convexo-concave patterns was formed by an iteration of an element shown in FIG. 14 made by rotating or changing the direction of the element, and the convexed portions and the concaved portions had the same contour shape. The bending rigidity was calculated while changing the direction of the bending axis at a step of 15 degrees around the center of the square. And the ratio between the maximum value and minimum value of the calculated bending rigidity was obtained to evaluate the anisotropy of the bending rigidity.

The results are shown in Table 1. As shown, the test example 1 having the pattern shown in FIG. 4 showed the smallest anisotropy.

Further, the ratio of the maximum value of the bending rigidity and that of flat plate was obtained.

The results are also shown in Table 1. As shown, the test examples 1 to 3 had higher bending rigidity of about 7 to 15 times that of the flat plate although the material thickness was smaller than that of the flat plate.

TABLE 1

| | Flat plate — | Test example 1 FIG. 4 | Test example 2 FIG. 9 | Test example 3 FIG. 12 |
|---|---|---|---|---|
| Thickness t (mm) | 0.30 | 0.26 | 0.26 | 0.27 |
| Size (mm) | 120 × 120 | 120 × 120 | 120 × 120 | 120 × 120 |
| Elastic modulus (GPa) | 100 | 100 | 100 | 100 |
| Poisson's ratio | 0.3 | 0.3 | 0.3 | 0.3 |
| Height difference h (mm) | 0 | 2.0 | 2.0 | 2.0 |
| bending rigidity Anisotropy (max/min) | 1.0 | 1.3 | 2.0 | 1.6 |
| Bending rigidity relative to flat plate (times) | 1 | 7 | 10 | 15 |

[Performance Evaluation 2]

Further, in order to evaluate the rigidity of the test example 1 when applied to the curved crown portion of a golf club head, a test example 4 was prepared by curving the test example 1 along a sphere in the computer-simulation so that the boundary between the convexed portions and the concaved portions (boundary N shown in FIG. 6) was positioned on the spherical surface having 185 mm radius.

As shown in FIG. 5, the test example 4 was formed in a circle having a radius of 60 mm in its plan view.

In order to obtain the rigidity, the outer peripheral edge of the test example 4 was completely restrained or fixed to a flat plane, and a load from 0 to 100 N in the perpendicular direction to the flat plane was applied to the central point of the convexed surface the test example 4, and the deformation was calculated to obtain the displacement in the perpendicular direction of the central point.

Such deformation calculation was performed by changing the thickness to 0.30 mm, 0.35 mm and 0.40 mm, and changing the height difference h to 3.0 mm, 2.0 mm and 1.0 mm for each thickness.

Further, a comparative example which was the same as the test example 4 except that the thickness was 0.5 mm and no convexo-concave pattern was provided, was prepared and deformation calculation was performed similarly.

Figure 16:
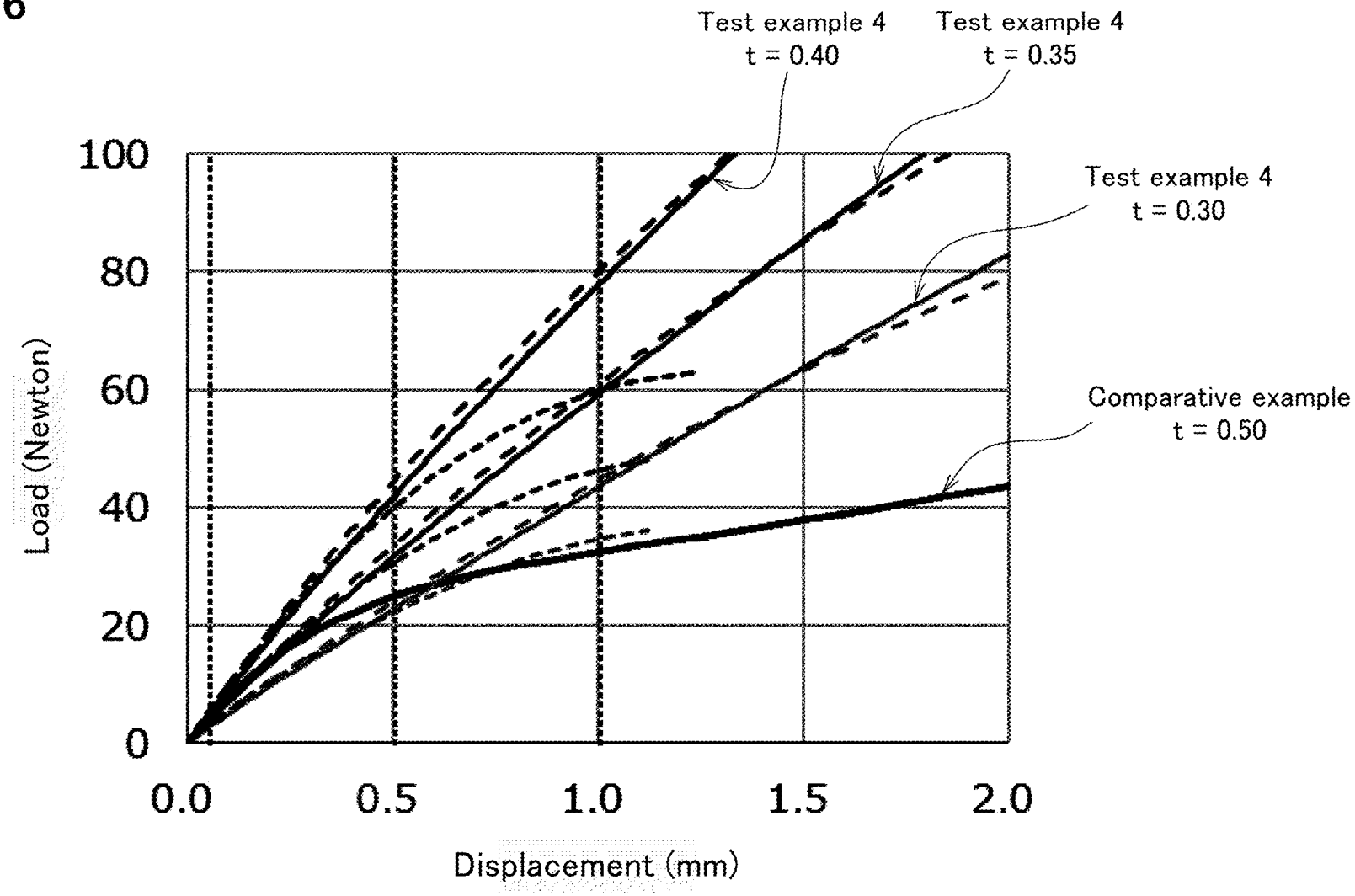
FIG. 16 is a graph showing the relationship between the load and the displacement in the test example 4.

The obtained simulation results are shown in FIG. 16, wherein the vertical axis of this graph indicates the applied load, and the horizontal axis indicates the displacement thereby. In the graph, for each thickness of the test example 4, line types indicate the height difference h as follows.

Solid line: height difference h=3.0 mm

Long dashed line: height difference h=2.0 mm

Short dashed line: height difference h=1.0 mm

As is clear from FIG. 16, it was confirmed that the test examples 4 had higher rigidity (N/mm) even though the wall thickness is smaller than the comparative example.

In general, displacement of a metal golf club head at the time of hitting a ball is at most 1.0 mm. In such a displacement range, the rigidity becomes highest when the height difference h is 2.0 mm at any thickness.

Further, it was found that, when the height difference h is in a range from 2.0 to 3.0 mm, the load and the displacement had a substantially linear relationship at any thickness.

Further, it was confirmed that, compared to the comparative example, the mass of the test examples 4 was reduced by about 1.7 g when the thickness t=0.30 mm and about 1.0 g when the thickness t=0.40 mm. Such reduced mass can be utilized to increase the moment of inertia of the golf club head.

DESCRIPTION OF THE REFERENCE SIGNS

1 Golf club head
2 Face portion
10 Convexoconcave-wall portion
100 Convex portion
101 First protrusion
102 Second protrusion
200 Concave portion
201 First concaved portion
202 Second concaved portion
203 L-shaped unit
D1 First direction
D2 Second direction

The invention claimed is:

1. A golf club head having a cavity therein and comprising:

a wall at least a part of which is formed as a convexo-concave wall portion, wherein the convexo-concave wall portion is composed of convexed portions repeatedly arranged in a first direction and a second direction intersecting the first direction, and concaved portions, and each of the convexed portions is made up of four first protrusions extending straight in the first direction and four second protrusions extending straight in the second direction, wherein each of the four first protrusions is connected to one of the four second protrusions so as to form an L-shaped convex unit, and the convexed portion is made up of the four L-shaped convex units which are arranged around a center of the convexed portion by rotating at an angular pitch of 90 degrees so as to have a swastika contour shape, wherein the concaved portions are arranged so that each of the concaved portions has the same swastika contour shape as the swastika contour shape of the convexed portion, the convexo-concave wall portion is made of a metal material, the thickness of the metal material in the convexo-concave wall portion is in a range from 0.25 to 0.50 mm, and the difference in height between the convexed portions and the concaved portions is in a range from 0.6 to 4.0 mm.

2. The golf club head according to claim 1 wherein the convexo-concave wall portion constitutes a curved portion of the wall.

3. The golf club head according to claim 1, wherein the first direction is parallel with a front-back direction of the golf club head, and the second direction is parallel with a toe-heel direction of the golf club head.

4. The golf club according to claim 3, wherein the convexed portions are each formed in such a size that a smallest square, which circumscribes the convexed portion in the plan view of the convexed portion, has four sides whose length is 10 to 40 mm, and two of the four sides are parallel with the first direction.

5. The golf club head according to claim 1, wherein the convexo-concave wall portion has an outer surface having a pattern formed by the convexed portions and the concaved portions and an inner surface having a complementary pattern such that second convexed portions in the inner surface are formed at the same positions and have the same contour shapes as the respective concaved portions in the outer surface, and second concaved portions in the inner surface are formed at the same positions and have the same contour shapes as the respective convexed portions in the outer surface.

6. The golf club head according to claim 1, wherein the convexo-concave wall portion is provided in a rear part of a crown wall forming an upper surface of the head, and a front part of the crown wall extending along an upper edge of a face portion is not provided with the convexo-concave wall portion.

7. The golf club head according to claim 6, wherein the area of the convexo-concave wall portion is in a range from 10% to 95% of the overall area of the golf club head, when measured in the top view of the golf club head under its standard state.

8. A golf club head having a cavity therein and comprising:

a wall at least a part of which is formed as a convexo-concave wall portion, wherein the convexo-concave wall portion is composed of convexed portions repeatedly arranged in a first direction and a second direction intersecting the first direction, and concaved portions, and each of the convexed portions is made up of two first protrusions extending straight in the first direction and two second protrusions extending straight in the second direction, wherein each of the first and second protrusions has a rectangular shape, the two first protrusions extend parallel to each other and are displaced from each other in the second direction, and the two second protrusions extend in parallel with each other and are displaced from each other in the first direction, so that each convexed portion has such a contour shape that is formed by positioning one of four corners of the rectangular shape at a point and rotating the rectangular shape every 90 degrees around said point, wherein the concaved portions are arranged so that each of the concaved portions has the same contour shape as the contour shape of the convexed portion, the convexo-concave wall portion is made of a metal material, the thickness of the metal material in the convexo-concave wall portion is in a range from 0.25 to 0.50 mm, and the difference in height between the convexed portions and the concaved portions is in a range from 0.6 to 4.0 mm.

9. The golf club head according to claim 8 wherein the convexo-concave wall portion is provided in a rear part of a crown wall forming an upper surface of the head, and a front part of the crown wall extending along an upper edge of a face portion is not provided with the convexo-concave wall portion.

10. The golf club head according to claim 9, wherein the area of the convexo-concave wall portion is in a range from 10% to 95% of the overall area of the golf club head, when measured in the top view of the golf club head under its standard state.

11. The golf club head according to claim 10, wherein the convexo-concave wall portion constitutes a curved portion of the wall.

12. The golf club head according to claim 8, wherein the convexo-concave wall portion has an outer surface having a pattern formed by the convexed portions and the concaved portions and an inner surface having a complementary pattern such that second convexed portions in the inner surface are formed at the same positions and have the same contour shapes as the respective concaved portions in the outer surface, and second concaved portions in the inner surface are formed at the same positions and have the same contour shapes as the respective convexed portions in the outer surface.

13. A golf club head having a cavity therein and comprising:

a wall at least a part of which is formed as a convexo-concave wall portion, wherein the convexo-concave wall portion is composed of convexed portions repeatedly arranged in a first direction and a second direction intersecting the first direction, and concaved portions, and each of the convexed portions is made up of one first protrusion extending straight in the first direction and two second protrusions each extending straight in the second direction and respectively connected to both ends of the first protrusion so that each convexed portion has a contour shape resembling a capital "I" or "H" shape, wherein the concaved portions are arranged so that each of the convexed portions has the same contour shape as the contour shape resembling a capital "I" or "H" shape, of the convexed portion, the convexo-concave wall portion is made of a metal material, the thickness of the metal material in the convexo-concave wall portion is in a range from 0.25 to 0.50 mm, and the difference in height between the convexed portions and the concaved portions is in a range from 0.6 to 4.0 mm.

14. The golf club head according to claim 13 wherein the convexo-concave wall portion is provided in a rear part of a crown wall forming an upper surface of the head, and a front part of the crown wall extending along an upper edge of a face portion is not provided with the convexo-concave wall portion.

15. The golf club head according to claim 14, wherein the area of the convexo-concave wall portion is in a range from 10% to 95% of the overall area of the golf club head, when measured in the top view of the golf club head under its standard state.

16. The golf club head according to claim 15, wherein the convexo-concave wall portion constitutes a curved portion of the wall.

17. The golf club head according to claim 13, wherein the convexo-concave wall portion has an outer surface having a pattern formed by the convexed portions and the concaved portions and an inner surface having a complementary pattern such that second convexed portions in the inner surface are formed at the same positions and have the same contour shapes as the respective concaved portions in the outer surface, and second concaved portions in the inner surface are formed at the same positions and have the same contour shapes as the respective convexed portions in the outer surface.

* * * * *